US006053027A

United States Patent [19]

Yoshizawa

[11] Patent Number: 6,053,027

[45] Date of Patent: Apr. 25, 2000

[54] PRESS APPARATUS AND PRESS SYSTEM

[75] Inventor: Yasuo Yoshizawa, Yonezawa, Japan

[73] Assignee: Yoshiki Industrial Co., Ltd., Yamagata-ken, Japan

[21] Appl. No.: 09/117,241

[22] PCT Filed: Nov. 26, 1997

[86] PCT No.: PCT/JP97/04308

§ 371 Date: Sep. 1, 1998

§ 102(e) Date: Sep. 1, 1998

[87] PCT Pub. No.: WO98/23438

PCT Pub. Date: Jun. 4, 1998

[30] Foreign Application Priority Data

Nov. 28, 1996 [JP] Japan ..... 8-318011

[51] Int. Cl.[7] ..... B21J 7/46

[52] U.S. Cl. ..... 72/442; 72/450; 72/452.4

[58] Field of Search ..... 72/441, 442, 449, 72/450, 452.4

[56] References Cited

U.S. PATENT DOCUMENTS

| | | | |
|---|---|---|---|
| 4,364,257 | 12/1982 | Endo et al. | 72/450 |
| 4,724,873 | 2/1988 | Abe | 72/442 |
| 5,138,922 | 8/1992 | Eigenmann | 72/450 |
| 5,269,739 | 12/1993 | Maynard et al. | 72/442 |

FOREIGN PATENT DOCUMENTS

| | | |
|---|---|---|
| 58-104000 | 6/1983 | Japan . |
| 62-173097 | 7/1987 | Japan . |
| 3-90295 | 4/1991 | Japan . |
| 8-10997 | 1/1996 | Japan . |

*Primary Examiner*—David Jones
*Attorney, Agent, or Firm*—Frishauf, Holtz, Goodman, Langer & Chick, P.C.

[57] ABSTRACT

A support frame (14) is provided above a base (10), defining a working space (16) together with the support frame. An automatic die-replacing mechanism (24) is provided in the working space, for moving a selected one of a plurality of die units (78) to a predetermined working position. A support base table is provided with an elevating axle (18) for opening and closing the die unit located at the working position, and a drive mechanism section for moving the elevating axle up and down. The drive mechanism section has a pulse servomotor (38) and an oscillating-fulcrum mechanism (22) for transmitting a drive force to the elevating axle. The oscillating arm (46) of the oscillating-fulcrum mechanism has a fulcrum section supported by the support table, a power-point section supported by a shaft which is rotated by the pulse servomotor, and an application-point section coupled to the elevating axle.

10 Claims, 16 Drawing Sheets

PRESS APPARATUS AND PRESS SYSTEM

TECHNICAL FIELD

The present invention relates to a press apparatus, and more particularly to a press apparatus and a press system, which has an oscillating-fulcrum mechanism.

BACKGROUND ART

In recent years, it has become trendier in the industrial field to manufacture various products, each in smaller and smaller quantities. To manufacture various products with a single press apparatus, it is necessary to replace a die for making a product, with another die for manufacturing another product. Recently, a die quick-changing (DQC) system has been developed to shorten the time required for replacing dies. Generally the DQC system comprises two movable bolsters. While one bolster is operating, the die to be used next is set on the other bolster. That is, a die is replaced with another as the first bolster is replaced with the second bolster. A die is set up every time before it is used to replace another die.

A press apparatus may perform press working at several parts of a work. If the parts of the work differ in position, different dies must be used even if all parts of the work have the same shape. In such a case, a die is replaced with another to conduct press working on a new part of the work.

There is known another method of performing press working on several parts of a work. In this method, a plurality of press apparatuses are arranged side by side, and the work is moved to these press apparatuses sequentially, undergoing press working at each press apparatus. In this method, the press apparatuses, each having a different die, are used in the same number as the parts of the work which assume different positions and which must be press-worked.

With the press apparatuses hitherto used in general, such as crank press and toggle press, it is necessary to adjust the bottom dead center of the slider in accordance with the die employed. Every time a die replaces another, its position needs to be adjusted not only in the X and Y directions, but also in the Z direction. Hence, it would take a long time to set up the die to replace another die even in the conventional DQC system. It is therefore difficult to achieve a substantial improvement.

A plurality of press apparatuses used to perform press working on several parts of a work can serve to manufacture but one type of a product, unless the die attached to each apparatus is replaced by another. This is because each press apparatus cannot have its position adjusted.

DISCLOSURE OF INVENTION

The present invention has been made in view of the foregoing. Its object is to provide a press apparatus and a press system, either capable of serving to manufacture various types of products.

To achieve the object mentioned above, a press apparatus according to the present invention comprises: a base; a support frame arranged above the base, defining a predetermined working space together with the base; an automatic die-replacing mechanism having a plurality of die units disposed in the working space, for moving a selected one of the die units to a prescribed working position; an elevating axle supported by the support frame to move up and down freely for opening and closing the die unit set at the working position; drive means provided on the support frame; and an oscillating-fulcrum mechanism for transmitting a drive force of the drive means to the elevating axle, thereby to move the elevating axle up and down.

The press apparatus is characterized in that the oscillating-fulcrum mechanism comprises: a shaft supported by the support frame, to be rotated by the drive means; an eccentric core formed integral with the shaft and positioned eccentric thereto; an oscillating arm having a power-point section supported to rotate freely around the eccentric core, a fulcrum section and an application-point section located on both sides of the power-point section; a fulcrum regulator coupling the fulcrum section of the oscillating arm with the elevating axle, allowing the same to rotate freely and to oscillate linearly in a predetermined direction intersecting with a direction in which the elevating axle moves up and down; and an application-point regulator supporting the application-point section of the oscillating arm, allowing the same to rotate freely and oscillate linearly in a predetermined direction intersecting with the direction in which the elevating axle moves up and down.

A press system according to the invention comprises: a plurality of press apparatuses arranged in a row on a base;

a transport mechanism for conveying works through each of the press apparatuses;

a plurality of position-adjusting mechanisms, each arranged between the base and one press apparatus and supporting the press apparatus, for adjusting a position of the press apparatus with respect to the transport mechanism;

wherein each of the press apparatuses comprises a base provided on the position-adjusting mechanism, a support frame arranged above the base, defining a predetermined working space together with the base, a die unit provided in the working space, an elevating axle supported by the support frame to be movable up and down to open and close the die unit, drive means provided on the support frame, and an oscillating-fulcrum mechanism for transmitting a drive force of the drive means to the elevating axle, thereby to move the elevating axle up and down, the oscillating-fulcrum mechanism comprising:

a shaft supported by the support frame, to be rotated by the drive means;

an eccentric core formed integral with the shaft and positioned eccentric thereto;

an oscillating arm having a power-point section supported to rotate freely around the eccentric core, a fulcrum section and an application-point section which are located on both sides of the power-point section;

a fulcrum regulator supporting the fulcrum section of the oscillating arm, allowing the same to rotate freely and to oscillate linearly in a predetermined direction intersecting with a direction in which the elevating axle moves up and down; and an application-point regulator coupling the fulcrum section of the oscillating arm with the elevating axle, allowing the same to rotate freely and oscillate linearly in a predetermined direction intersecting with the direction in which the elevating axle moves up and down, and wherein the transport mechanism comprises an endless belt member having a forward-going part which runs through the working space of each press apparatus and a backward-going part which runs through the base of each press apparatus, and supporting a plurality of works, drive mechanism for stopping the belt member to locate the works at positions where the works oppose the die units of the press apparatuses.

BEST MODE OF CARRYING OUT THE INVENTION

An embodiment of the invention, which is a barring press apparatus, will be described in detail, with respect to the accompanying drawings.

Figure 1:
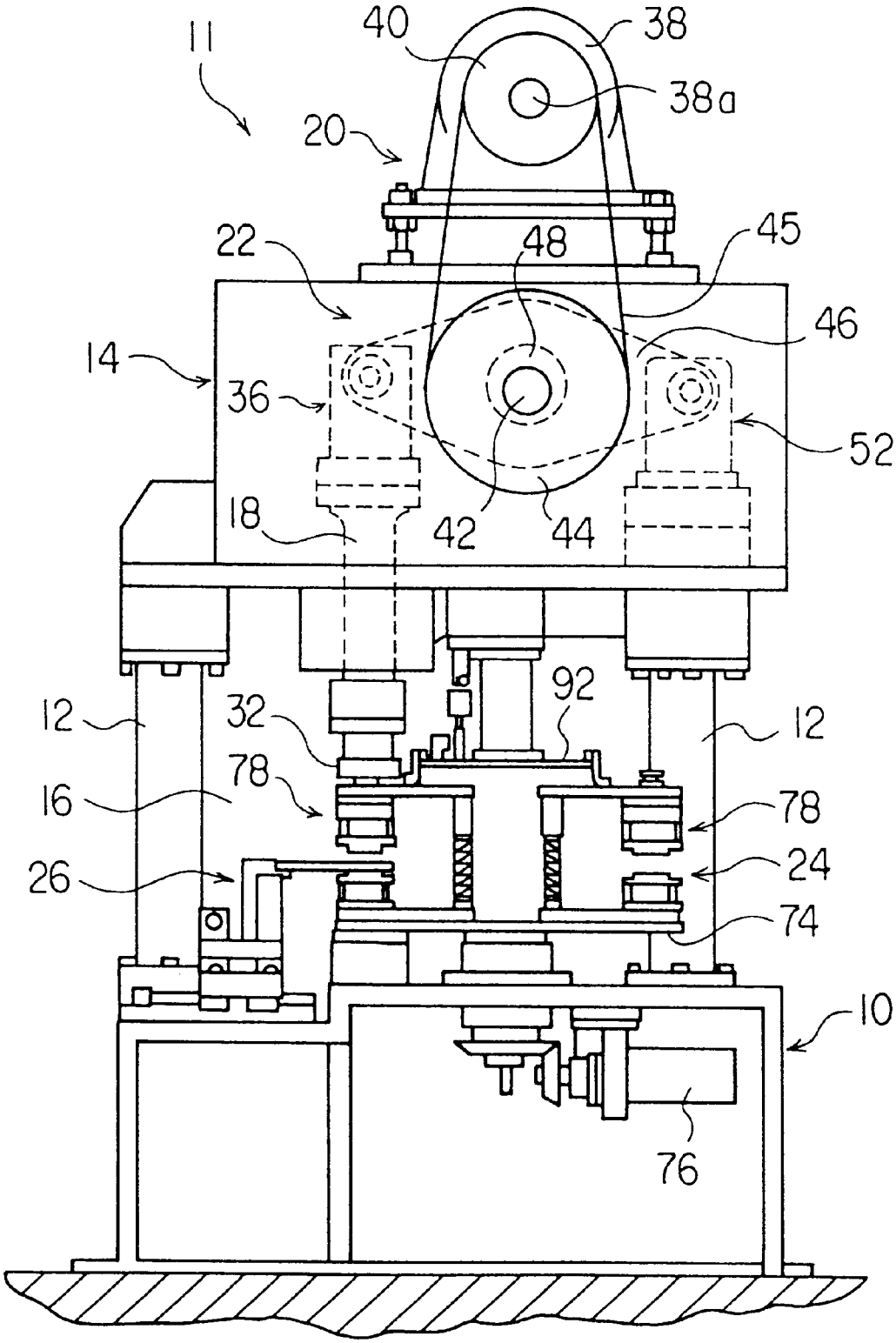
FIG. 1 is a side view showing a bar-ring press apparatus according to the invention, in its entirety.

The entire apparatus will be first described in brief. As shown in FIG. 1, the bar-ring press apparatus 11 comprises a base 10. Four posts 12 stand on the base 10, supporting a support frame 14. A working space 16 is provided between the base 10 and the support frame 14.

The support frame 14 that functions as a support base is equipped with an elevating axle 18. The elevating axle 18 is provided for opening and closing a die, which will be described later. The axle 18 is supported so as to be move up and down, in the vertical direction. A drive mechanism 20 and an oscillating-fulcrum mechanism 22 are mounted on the support frame 14. The drive mechanism 20 functions as drive means. The oscillating-fulcrum mechanism 22 is designed to transmit a drive force from the mechanism 20 to the elevating axle 18.

An automatic die-replacing mechanism 24 is provided in the working space 16. The mechanism 24 has a plurality of die units. The automatic die-replacing mechanism 24 moves any selected one of the die units to a working position where the die unit engages with the elevating axle 18, thereby automatically replacing one die with another.

A positioning mechanism 26 is mounted on the base 10, for positioning and holding a work with respect to the die unit.

Figure 2:
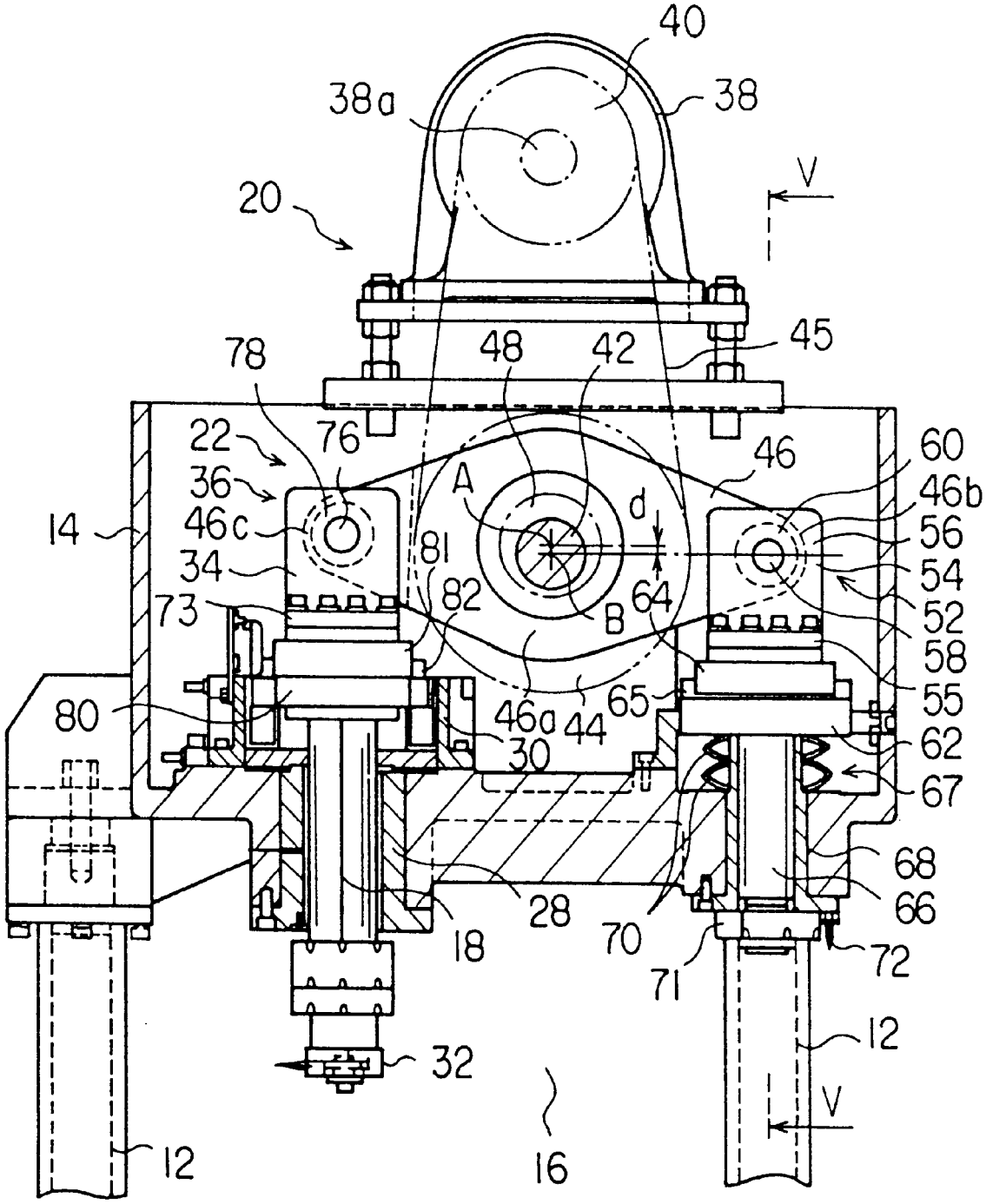
FIG. 2 is a sectional view illustrating the drive mechanism of the press apparatus.
Figure 3:
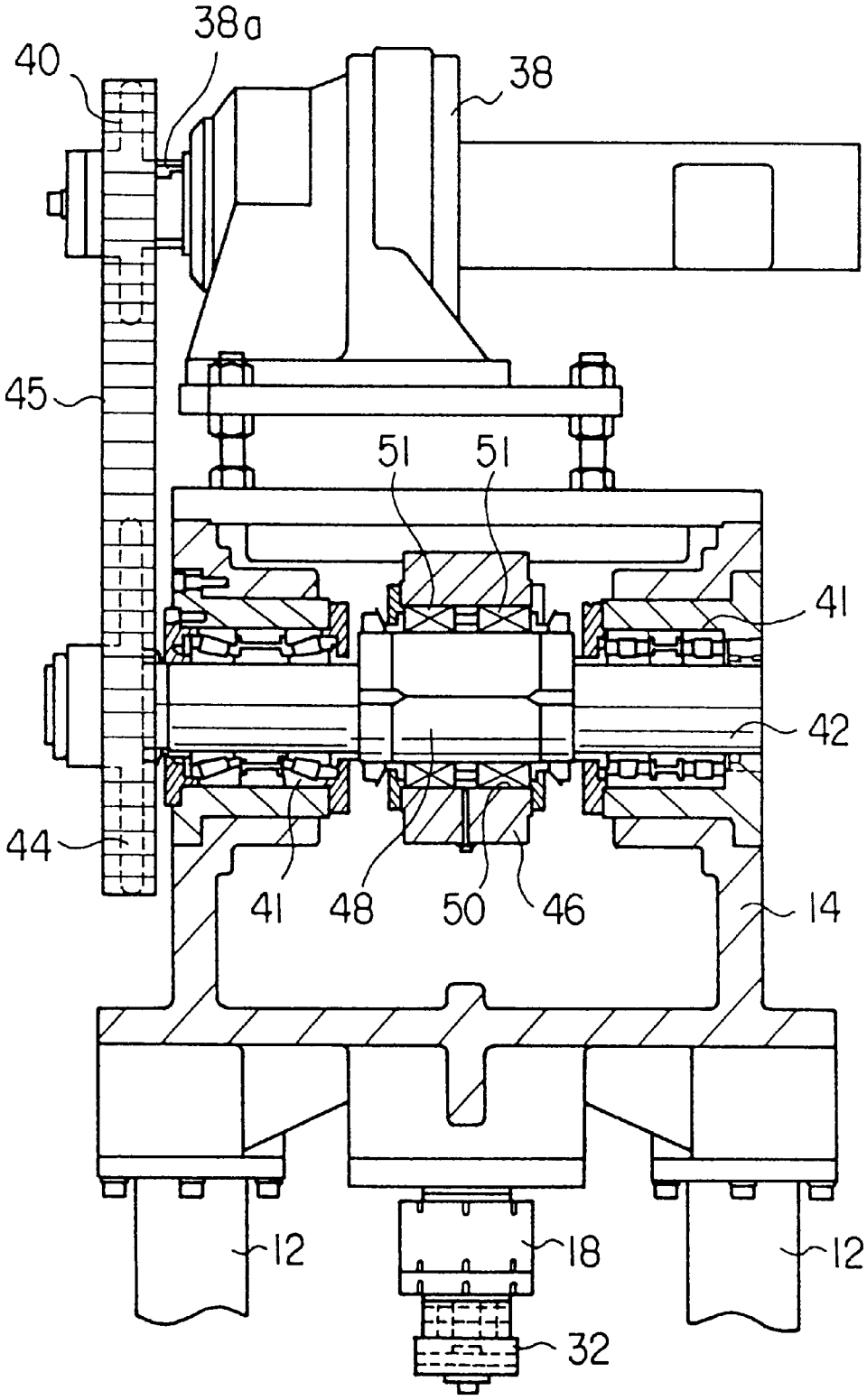
FIG. 3 is a sectional view illustrating the drive mechanism of the press apparatus.

The components of the apparatus will be described in detail. As shown in FIGS. 1 to 3, guide sleeves 28 and 30 are secured to the lower surface of the support frame 14. The guide sleeves 28 and 30 support the elevating axle 18, allowing the axle 18 to move up and down in the vertical direction. A holder 32 is provided at the lower end of the elevating axle 18, for holding a die unit. The holder 32 is located in the working space 16. The upper end portion of the elevating axle 18 extends in the support frame 14. A support block 34 is attached to the upper end of the axle 18. The block 34 is a part of an application-point regulator 36, which will be described later.

The drive mechanism 20 comprises a pulse servomotor 38 which is supported on the upper end of the support frame 14. The pulse servomotor 38 has a drive shaft 38*a* extending horizontally. A drive sprocket 40 is mounted on the distal end of the drive shaft 38*a*.

In the support frame 14, a shaft 42 is rotatably supported by a plurality of bearings 41. The shaft 42 is located below the pulse servomotor 38 and extends horizontally, in parallel to the drive shaft 38*a* of the pulse servomotor 38.

The shaft 42 has one end protruding outside from the support frame 14. A driven sprocket 44 is mounted on this end of the shaft 42. A drive chaarn 45 is wrapped around the drive sprocket 40 and the driven sprocket 44. The driven sprocket 44 has more teeth than the drive sprocket 40. Hence, the shaft 42 is driven at a predetermined reduction gear ratio when the pulse servo-motor 38 is driven.

The oscillating-fulcrum mechanism 22 is provided in the support frame 14. The mechanism 22 transmits a drive force from the mechanism 20 to the elevating axle 18, thereby to move the elevating axle 18 up and down. As shown in FIGS. 1 to 4, the oscillating-fulcrum mechanism 22 has an oscillating arm 46. The arm 46 oscillates as the shaft 42 rotates.

More specifically, a column-shaped eccentric core 48 is formed integral with that part of the shaft 42 which is middle with respect to the axis of the shaft 42. The eccentric core 48 has a larger diameter than the shaft 42 and an axis A deviated from the axis B of the shaft 42 by a prescribed distance d.

The oscillating arm 46 has a circular through hole 50 in the middle part that functions as a power-point section 46*a*. A bearing 51 is fitted in the through hole 50, and the eccentric core 48 is fitted in the bearing 51. The shaft 42 therefore supports the oscillating arm 46, which can rotate around the axis A of the eccentric core 48.

The ends of the oscillating arm 46 function as fulcrum section 46*b* and application-point section 46*c*, respectively. A fulcrum regulator 52 supports the fulcrum section 46*b*, allowing the section 46*b* to rotate and oscillate linearly in a line intersecting with the direction in which the elevating axle 18 moves up and down, particularly in the horizontal direction, or in a line extending at right angles to the shaft 42. The application-point regulator 36 connects the application-point section 46*c* to the upper end of the elevating axle 18. The application-point regulator 36 supports the section 46*c*, enabling the same to rotate and oscillate linearly in a line intersecting with the direction in which the elevating axle 18 moves up and down, particularly in the horizontal direction, or in a line extending at right angles to the shaft 42.

Figure 4:
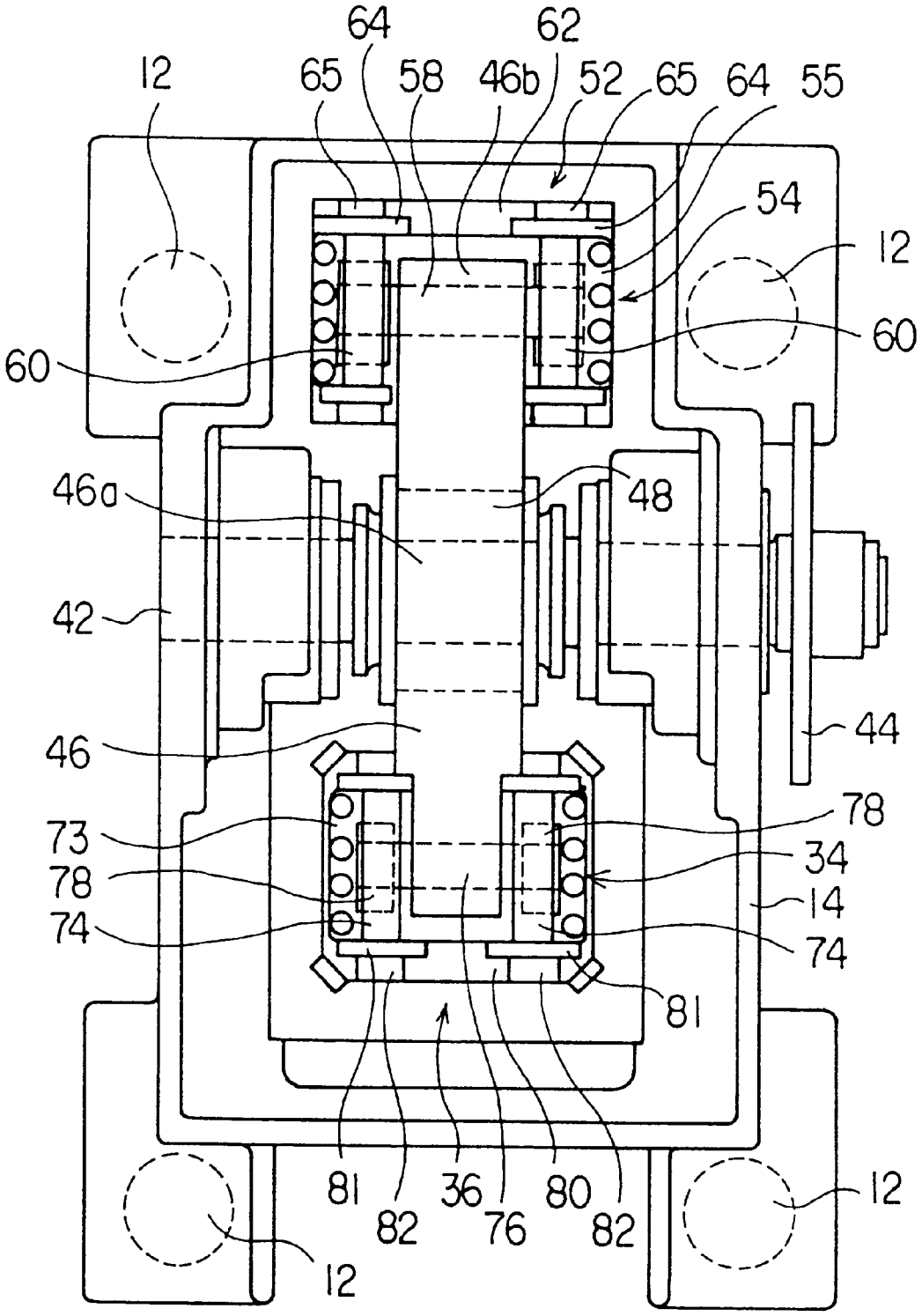
FIG. 4 is a plan view of the oscillating-fulcrum mechanism incorporated in the press apparatus.
Figure 5:
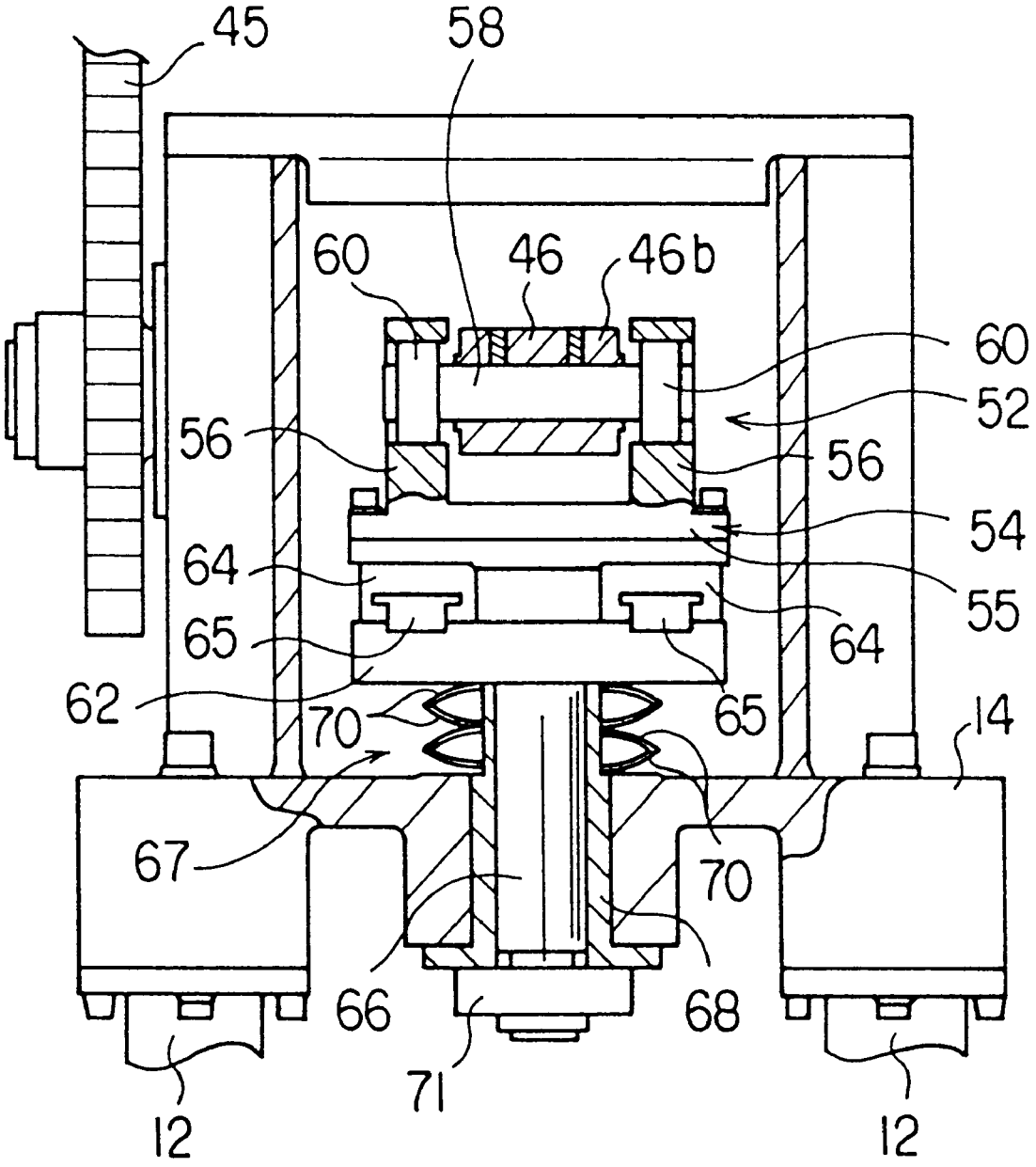
FIG. 5 is a sectional view taken along line V-V shown in FIG. 2.

As shown in FIGS. 2, 4 and 5, the application-point regulator 36 has a support block 54. The support block 54 comprises a base 55 and a pair of support walls 55. The base 55 is almost rectangular and is positioned horizontally. The support walls 55 extend upwardly from the base 55, sandwiching the fulcrum section 46*b* of the oscillating arm 46. A pivot 58 is to the fulcrum section 46*b* of the oscillating arm 46. The pivot 58 extends in parallel to the shaft 42 and is rotatably supported at both ends by bearings 60 fitted in the support walls 55.

A rectangular support plate 62 is provided below the base 55, extending parallel to the base 55. A pair of parallel sliding guides 64 is secured to the lower surface of the base 55. A pair of parallel guide rails 65 are laid on the upper surface of the support plate 62. The sliding guides 64 are set in sliding engagement with the guide rails 65, respectively.

The sliding guides 64 and the guide rails 65 extend parallel to one another and at right angles to the shaft 42. Thus, the support plate 62 supports the support block 54 and the fulcrum section 64*b* of the oscillating arm 46, which is rotatably supported by the block 54, allowing the plate 62 and the section 46*b* to oscillate linearly along the guide rails.

The support block 54 and the support plate 62 are supported by a relief mechanism 67, which in turn is supported by the support frame 14. The relief mechanism 67 comprises a support rod 66 and four belleville springs 70. The support rod 66 extends downwardly and vertically from the support plate 62. The belleville springs 70 work as bias means.

The support rod 66 extends through a guide sleeve 68 fixed to the support frame 14 and can move up and down. The belleville springs 70 are mounted on the guide sleeve 68 and located between the support frame 14 and the lower surface of the support plate 62. The belleville springs 70 bias the support plate 62 upwardly. The position-adjusting nut 71 set in screw engagement on the lower end of the support rod 66 is thereby held in contact with the lower end of the guide sleeve 68.

Therefore, the relief mechanism 67 usually holds the fulcrum regulator 52 such that the pivot 58 is located at its operating position, or at the same level as the shaft 42. When the load applied on the fulcrum regulator 52 through the oscillating arm 46 increases above a predetermined value, the relief mechanism 67 operates, relieving the load on the fulcrum regulator 52, as will be described later. More precisely, when a load greater than the predetermined value is applied on the regulator 52, the four belleville springs 70 elastically deform, lowering the support plate 62 and the support rod 66 together with the fulcrum regulator 52 and thus relieving the load on the regulator 52.

As the support rod 66 thus lowers, the position-adjusting nut 71 also lowers, leaving from the lower end of the lower end of the guide sleeve 68. The overload sensor 72 attached to the position-adjusting nut 71 detects the operation of the relief mechanism 67 in accordance with the motion of the position-adjusting nut 71.

The application-point regulator 36 has almost the same structure as the fulcrum regulator 52. As shown in FIGS. 2 and 3, the application-point regulator 36 comprises the support block 34. The support block 34 comprises a base 73 and a pair of support walls 74. The base 73 is almost rectangular, extending horizontally. The support walls 74 stand upwardly from the base 73, sandwiching the application-point section 46*c* of the oscillating arm 46. Fixed to the application-point section 46*c* of the oscillating arm 46 is a pivot 76 that extends parallel to the shaft 42. The pivot 76 is rotatably connected at both ends to the support walls 74 by means of cylindrical roller bearings 78.

The support block 34 is mounted on a rectangular support plate 60 secured to the upper end of the elevating axle 18. A pair of sliding guides 81, which extend parallel to each other, are fastened to the lower surface of the base 73. A pair of guide rails 82, which extend parallel to each other, are laid on the upper surface of the support plate 80. The sliding guides 81 are set in sliding engagement with the guide rails 82, respectively.

The sliding guides 81 and the guide rails 82 extend parallel to one another and at right angles to the shaft 42. Thus, the support block 34 and the fulcrum section 64*b* of the oscillating arm 46 is supported on the support plate 80 to oscillate linearly along the guide rails 82.

Figure 6A:
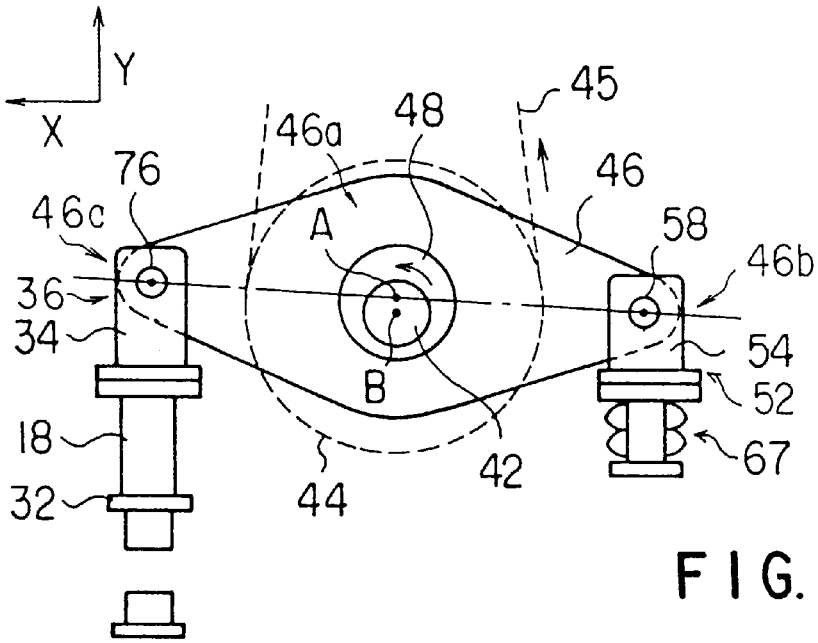
FIGS. 6A to 6C are schematic diagrams explaining the press working performed by the oscillating-fulcrum mechanism.
Figure 6B:
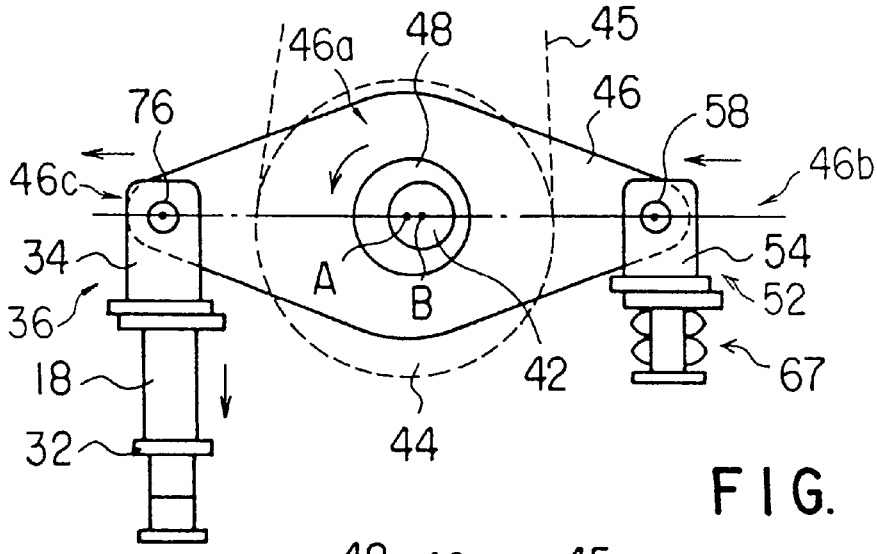
Figure 6C:
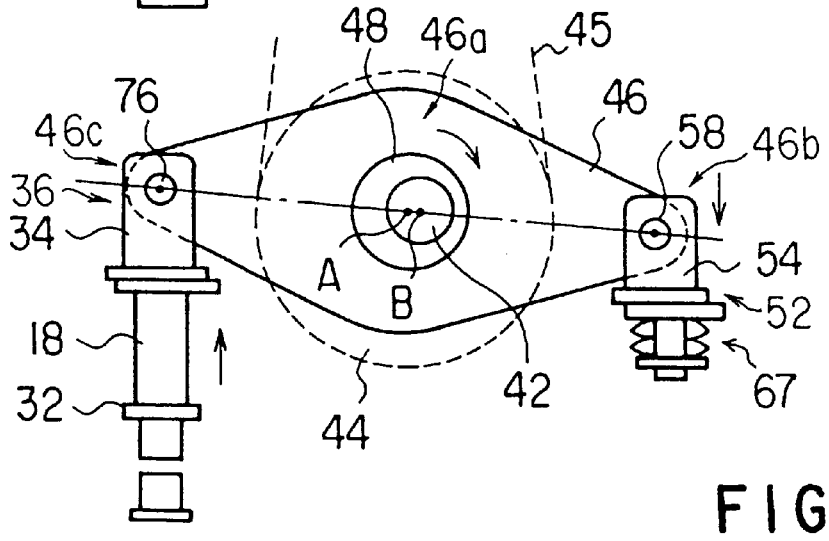

As FIGS. 6A to 6C schematically show, in the drive mechanism 20 and oscillating-fulcrum mechanism 22, the power-point section 46*a* of the oscillating arm 46 rotates counterclockwise around the axis B of the shaft 42, along with the eccentric core 48, when the pulse servo-motor 38 rotates the shaft 42 counterclockwise by a predetermined angle from the waiting position of FIG. 6A. At the same time, the power-point section 46*a* of the oscillating arm 46 oscillates counterclockwise around the axis A of the eccentric core 48.

The oscillating arm 46 as a whole oscillates counterclockwise around the pivot 58 secured to the fulcrum section 46*b*, and the support block 54 supporting the pivot 58 linearly moves to the left. The pivot 76 provided at the application-point section 46*c* of the oscillating arm 46 oscillates counterclockwise around the fulcrum section 46*b* and moves linearly to the left. Hence, the support block 34 holding the pivot 76 moves down, while moving to the left, thus lowering the elevating axle 18 to the bottom dead center, i.e., the press-working position. The die unit attached to the holder 32 connected to the elevating axle 18 is thereby closed, whereby press working is performed.

Conversely, the pulse servomotor 38 rotates the shaft 42 clockwise by the predetermined angle. In this case, the oscillating arm 46 returns to the waiting position, whereby the elevating axle 18 moves up from the press-working position to the initial position. As the axle 18 moves so, the die unit is opened.

In the press working described above, the pulse servomotor 38 is driven, moving the application-point section 46*c* of the oscillating arm 46 up and down in Y direction and also in X direction. The oscillating arm 46 compresses the X-direction motion to, for example, half and amplifies the Y-direction motion twice. Further, due to the operation of the application-point regulator 36, no X-direction component of force is generated. Only a Y-direction component of force acts upon the elevating axle 18.

At this time, the work applies a reaction force to the application-point section 46*c* of the oscillating arm 46. This reaction force is transmitted to the pulse servomotor 38 in the reverse direction. On the basis of the difference between the Y-direction component of force and the reaction force, the output of the pulse servomotor 38 is controlled to change this difference to a predetermined desirable value.

The reaction force the work exerts depends on the function based on the thickness of the work. In the application-point regulator 36 and fulcrum regulator 52, the active-side regulator and the passive-side regulator oscillate to their respective optimal positions. These minute oscillations move the application point and the fulcrum to the best possible positions, thus accomplishing low-vibration operation.

In the press-working position shown in FIG. 6B, the die unit exerts an upward reaction force on the elevating axle 18 when an excessive load is applied to close the die unit. A force is thereby applied to the oscillating arm 46 to rotate the arm 46 clockwise around the axis A of the eccentric core 48. Moreover, a force is applied via the pivot 58 to the support block 54 located at the fulcrum section 46*b*, to compress the belleville springs 70 of the relief mechanism 67. Namely, this force acts to lower the support block 54.

Thus, the belleville springs 70 of the relief mechanism 67 deform, moving the support block 54 down as shaune in FIG. 6*c*, when the load acting on the die unit exceeds the predetermined value. As a result, the oscillating axle 54 rotates clockwise and the elevating axle 18 moves upwardly. The load acting on the die unit is thereby relieved. The overload sensor 72 detects this operation of the relief mechanism 67, whereby the pulse servomotor 38 is automatically stopped. This can prevent damage to the die unit.

FIG. 6C shows that the elevating axle 18 greatly moves upwardly due to the operation of the relief mechanism 67 operates, as if to open the die unit. In fact, however, the elevating axle 18 moves up but only a little, and the die unit remains closed.

Figure 7:
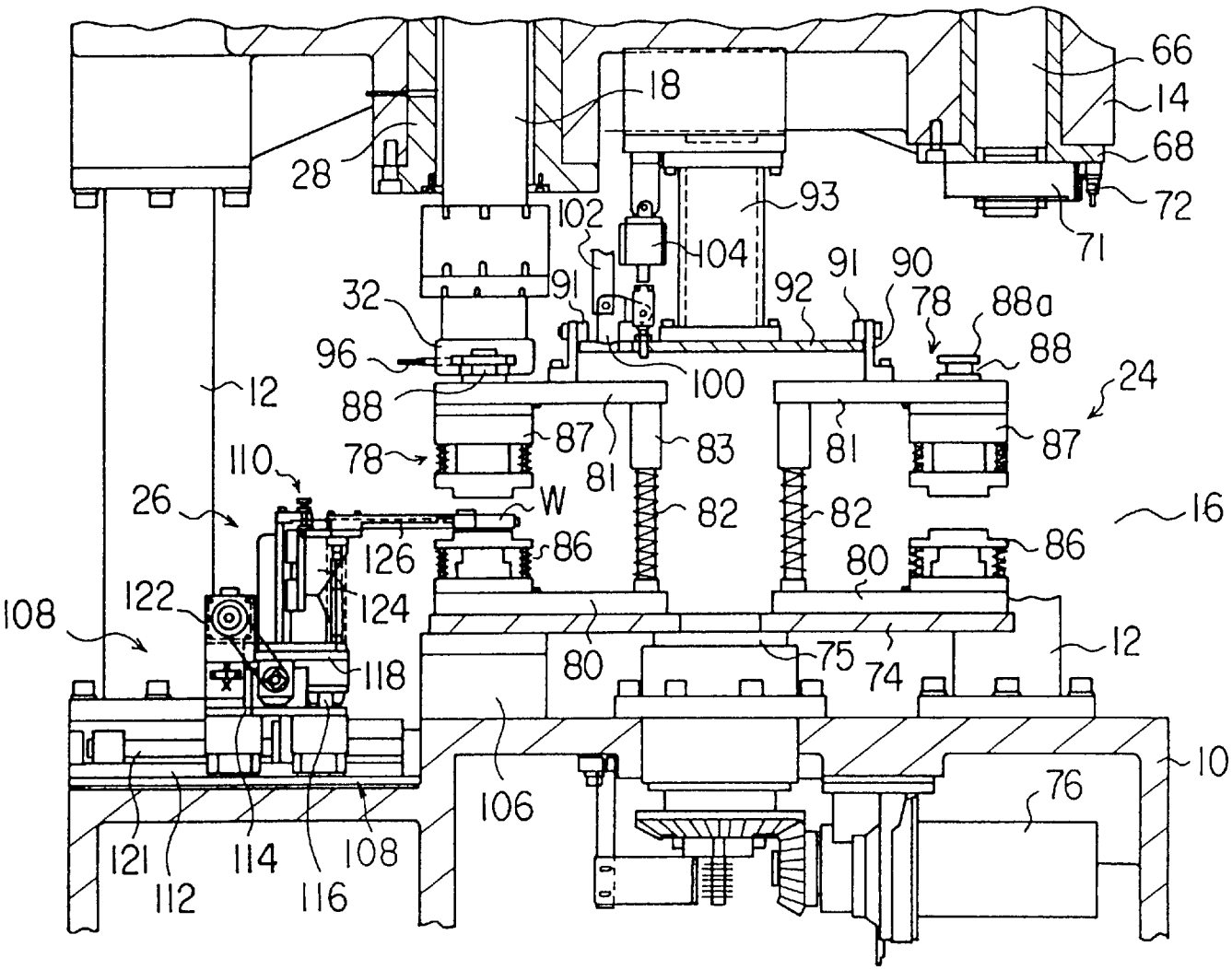
FIG. 7 is a side view showing the automatic die-replacing mechanism and the positioning mechanism, both incorporated in the press apparatus.
Figure 8:
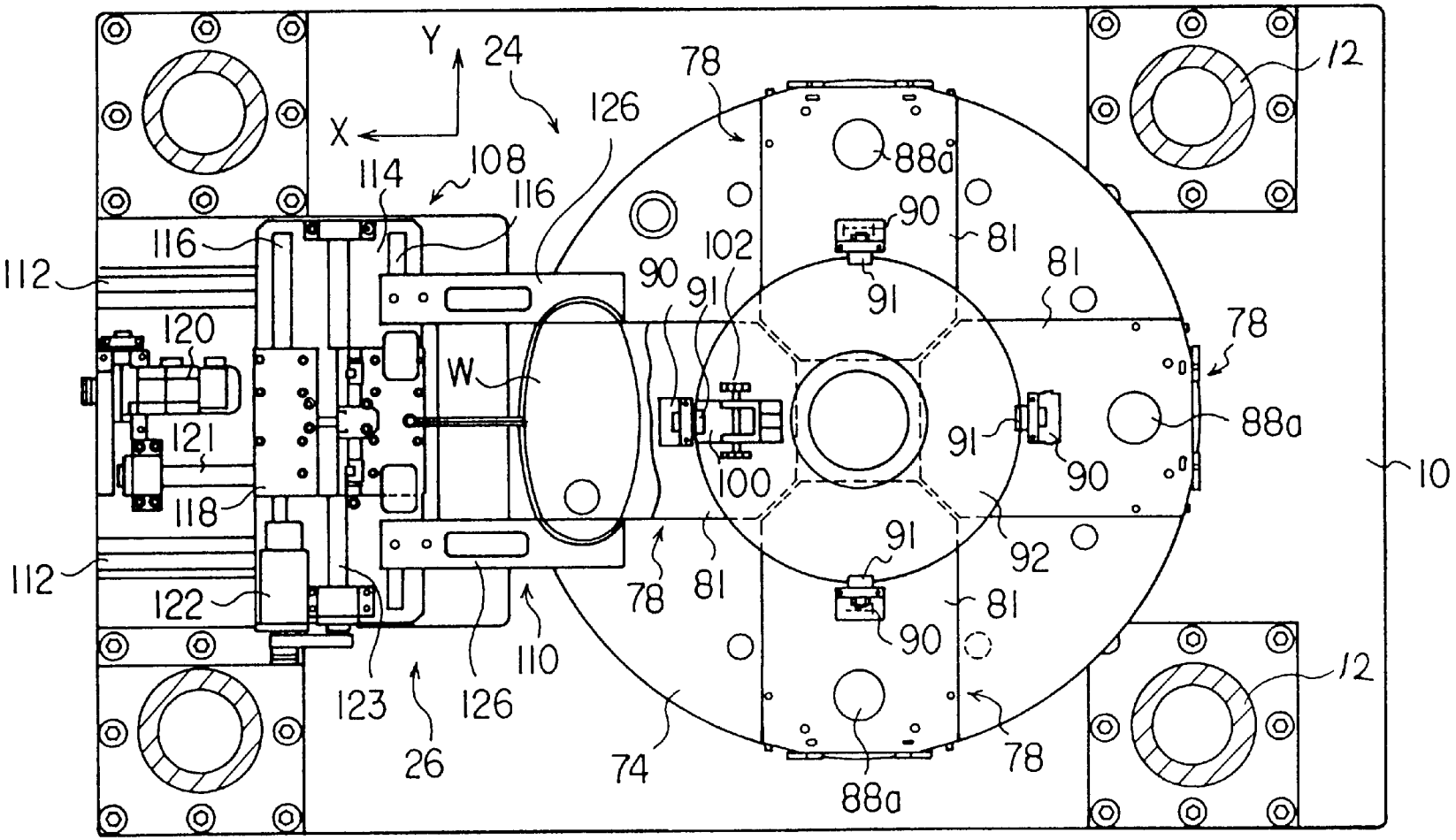
FIG. 8 is a plan view depicting the automatic die-replacing mechanism and the positioning mechanism, both incorporated in the press apparatus.

The automatic die-replacing mechanism 24 will be described in detail. As shown in FIGS. 7 and 8, the automatic die-replacing mechanism 24 has a disc-shaped turret table 74, which is provided, in the working space 16. The turret table 74 is positioned horizontally, rotatably supported at its center on the base 10 by means of a shaft 75 which extends vertically. The turret table 74 is rotated when the shaft 75 is driven by a pulse motor 76 provided in the base 10. The turret table 74 is located such that while it is rotating, its peripheral part passes beneath the elevating axle 18.

Figure 9:
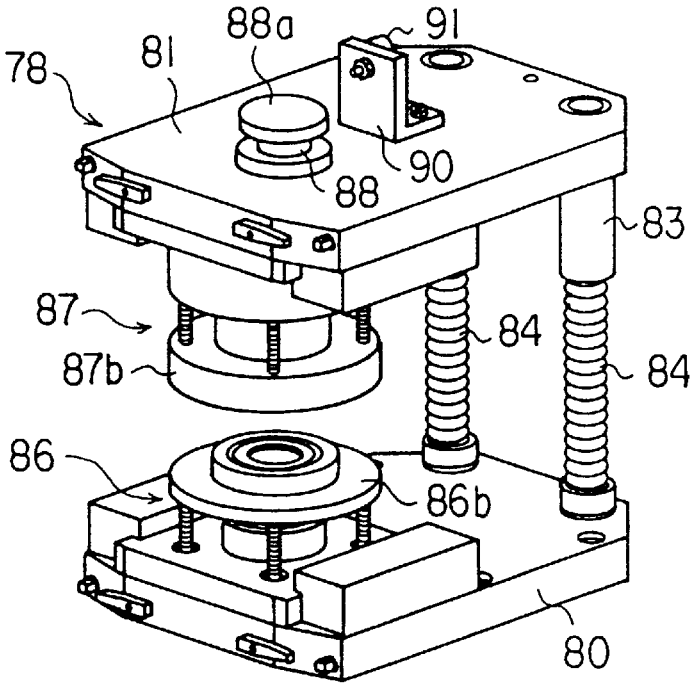
FIG. 9 is a perspective view of the die unit of the automatic die-replacing mechanism.
Figure 10:
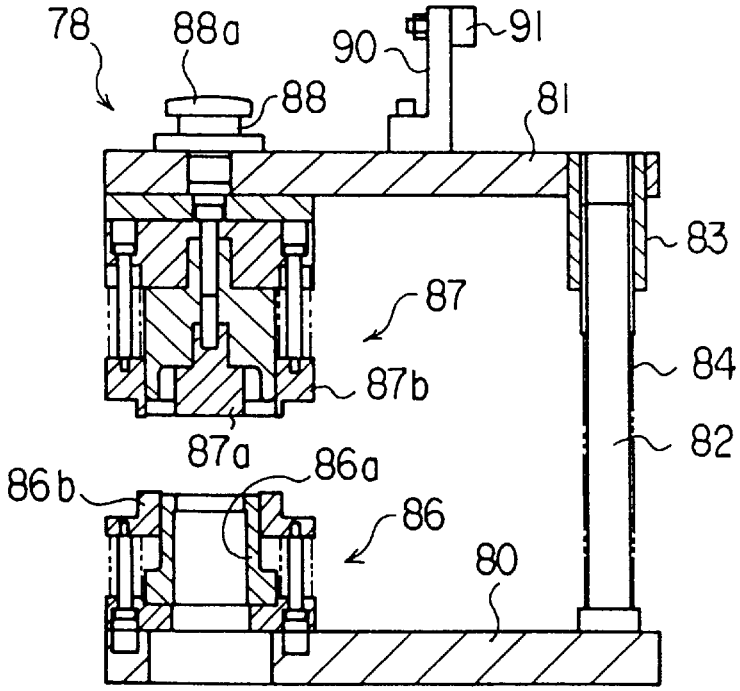
FIG. 10 is a sectional view of the die unit.

Four die units 78 are fixed in place on the turret table 74, equidistantly spaced apart from one another in the circumferential direction of the table 74. As seen from FIGS. 8 to 10, each die unit 78 has a lower plate 80 and an upper plate 81, either being substantially rectangular. These plates extend parallel to each other, spaced apart for a predetermined distance. A pair of guide posts 82 are secured to one end portion of the lower plate 80, extending upwardly and parallel to each other. A pair of guide sleeves 83 are secured to one end portion of the upper plate 81, extending downwardly and parallel to each other. The guideposts 82 have their upper end portions slidably inserted in the guide sleeves 83, respectively. A compression spring 84 is wound around each guidepost 82.

The upper plate 81 is thereby supported to move up and down with respect to the lower plate 80. Usually, the upper plate 81 is held by the compression springs 84, spaced apart from the lower plate 80 for the predetermined distance.

A lower die 86 is removably attached to the upper surface of the other end portion of the lower plate 80. An upper die 87 is removably secured to the lower surface of the other end portion of the upper plate 81, in axial alignment with the lower die 86. The lower die 86 has a die 86*a* and a holding ring 86*b*. The holding ring 86*b* mounted on the die 86*a* and can move up and down. The lower die 86 and the upper die 87 are opened and closed as the upper plate 81 moves up and down.

A shank 88 protrudes from the upper surface of the upper surface 81, in axial alignment with the upper die 87. The shank 88 functions as an engagement section has a head 88*a* on the disc. The upper end of the head 88*a* is spherical. An L-shaped bracket 90 is fixed to the upper surface of the upper plate 81, at the center part thereof. A support roller 91 having a horizontal shaft is rotatably secured to the bracket 90.

The four die units 78, each having the structure described above, are arranged on the turret table 74, each extending in the radial direction thereof. Each die unit 78 has one end located close to the guide posts 82 and at the center part of the turret table 74, and has the other end located close to the die and at the peripheral edge of the turret table 74. Four lower dies 86 different in shape for different purposes are attached to the four die units 78, respectively. Four upper dies 87 different in shape for different purposes are attached to the four die units 78, respectively.

As shown in FIGS. 7 and 8, the automatic die-replacing mechanism 24 has a support table 92 shaped like a disc and provided above the die units 78. The support table 92 is secured to the lower surface of the frame 14 by an axle 93 and positioned in axial alignment with the turret table 74.

The support table 92 has a predetermined outer diameter, positioned inside the brackets 90 secured to the die units 78 and at a predetermined level. The support roller 91 attached to the bracket 90 of each die unit 78 is set in rolling contact with the peripheral part of the upper surface of the support table 92. Thus, the upper plate 81 of each die unit 78 is supported by the support rollers 91 which in turn are supported by the support table 92 and is held at a predetermined level above the lower plate 80. When the turret table 74 rotates, the support rollers of the die units 78 roll on the peripheral part of the upper surface of the support table 92.

When the turret table 74 rotates, the die units 78 fixed on the turret table are moved, one after another, to the working position, where the shank 88 and the dies 86 and 87 of each die unit 78 are axially aligned. At the working position, the shank 88 of each die unit 78 is at such a level that it can engage with the holder 32 of the elevating axle 18 which has been moved to its high position. Here, the shank 88 moves in an arcuate path R which intersects with the holder 32.

Figure 11A:
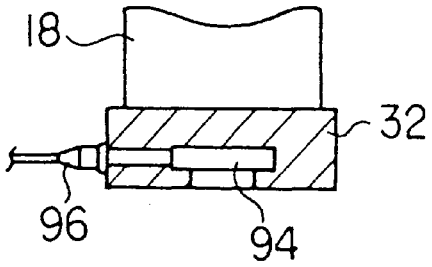
FIGS. 11A and 11B are a sectional view and bottom view, respectively, of the holder mounted on the elevating axle of the press apparatus.
Figure 11B:
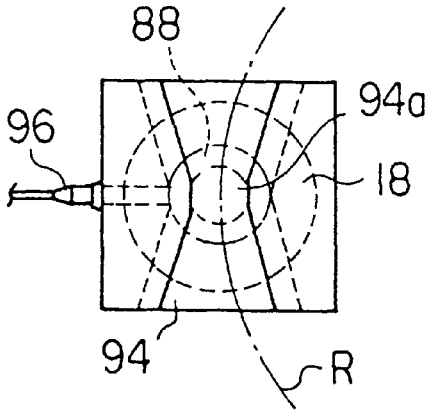

As illustrated in FIGS. 11A and 11B, the holder 32 of the elevating axle 18 has an engagement groove 94 having a stepped portion, in which the shank 88 can be fitted. The engagement groove 94 extends along the arcuate path R of the shank 88. The middle part 94*a* of the groove 94 is axially aligned with the elevating axle 18 and has the same width as the diameter of the shank 88. The groove 94 flares from the middle part 94*a* toward either end. An engagement sensor 96 is attached to the holder 32, for detecting the shank 88 engaged in the groove 94 when the shank 88 moves to the middle part 94*a* of the groove 94.

When any die unit 78 moves to a position below the elevating axle 18 as the turret table 74 rotates, the shank 88 of the die unit 78 enters, at its one end, the engagement groove 94 of the holder 32 and moves along the engagement groove 94. When the shank 88 reaches the middle part 94*a* of the groove 94, the engagement sensor 96 detects the end of the shank 88 at the middle part 94*a* of the groove 94, stopping the servomotor 76. Therefore, the turret table 74 therefore stops rotating.

The die unit 78 is thereby stopped at the working position and connected by the holder 32 to the elevating axle 18.

Figure 12:
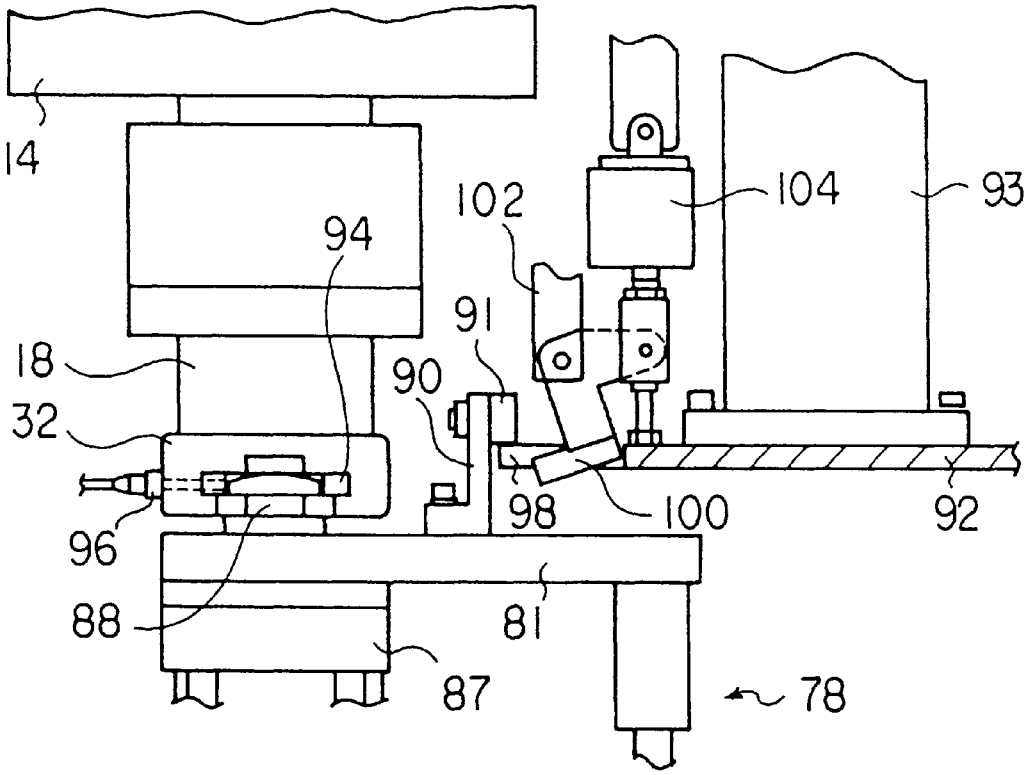
FIG. 12 is a side view showing the locking mechanism provided in the automatic die-replacing mechanism.

As shown in FIGS. 7 and 12, the support table 92 has an opening 98 in the part which opposes the die unit 78 which has been moved to the working position. The support roller 91 can pass through the opening 98. The support frame 14 has a lock mechanism for opening and closing the opening 98.

The lock mechanism has a lock lever 100. The lock lever 100 supported by a support arm 102 projecting from the support frame 14 and can rotate between a lock position and a lock-releasing open position. The lock lever 100 closes the opening 98 when it is rotated to the lock position, and opens when it is rotated to the lock-releasing position. The lock lever 100 is rotated between the lock position and lock-releasing position by means of a solenoid/plunger 104 attached to the support frame 14.

While set in the lock position shown in FIG. 7, the lock lever 100 remains flush with the surface of the support table 92, supporting the support roller 91 from below. Hence, the lock lever 100 prevents the support roller 91 from moving downwards, whereby the die unit is locked in opened state. When the lock lever 100 is rotated to the lock-releasing position as is shown in FIG. 12, it leaves the support roller 91 and opens the opening 98. The support roller 91 is thereby allowed to move down through the opening 98. As a result, the die unit 78 can be closed or opened.

As shown in FIG. 7, a support base 106 is provided on the upper surface of the base 10 and positioned in axial alignment with the elevating axle 18. The support table 106 is high enough to touch the lower surface of the turret table 74. Thus, the support base 106 supports the turret table 74 and the die unit 78 located at the working position, form below, and prevents displacement of the turret table 74 and the die unit 78.

To cause the automatic die-replacing mechanism 24 to replace the die unit 78 with a desired die unit automatically, the pulse motor 76 is driven, rotating the turret table 74. When the desired die unit 78 moves to the working position, the shank of this die unit 78 fits into the engagement groove 94 cut in the holder 32 of the elevating axle 18. The moment the die unit 78 moves to the working position, the engagement sensor 96 provided on the holder 32 detects the shank 88, stopping the pulse motor 76 and, hence, the turret table 74. The desired die unit 78 is thereby set at the working position and coupled to the elevating axle 18.

Then, the solenoid/plunger 104 is actuated, rotating the lock lever 100 from the lock position to the lock-releasing position. The support roller 91 is thereby released from the locked state, making it possible to open and close the die unit 78.

To replace the die unit 78 with still another one, the lock lever 100 is rotated to the lock position, and the turret table 74 is rotated. The shank 88 of the die unit 78 set at the working position moves out of the engagement groove 94 of the holder 32. The die unit 78 is automatically disconnected from the elevating axle 18. The still other die unit 78 is set at the working position in the same way as described above.

As shown in FIGS. 7 and 8, the positioning mechanism 26 which positions the work W with respect to the die unit 78 set at the working position comprises an X-Y table 108 and a chuck 110. The X-Y table 108 is provided on the base 10, beside the automatic die-replacing mechanism 24. The chuck 110 is mounted on and secured to the X-Y table 108.

The X-Y table 108 has an X table 114 and a Y table 118. The X table 114 can reciprocate on a pair of rails 112 laid on the upper surface of the base 10, in the X direction, namely along a line extending at right angles to the shaft 42 of the oscillating-fulcrum mechanism 22. The Y table 118 can reciprocate on a pair of rails 116 laid on the X table 114, in the Y direction, namely along a line extending parallel to the shaft 42.

The X table 114 is moved back and forth by a pulse motor 120 and a lead screw 121, both provided on the base 10. The Y table 118 is moved back and forth by a pulse motor 122 and a lead screw 123, both provided on the X table 114.

The chuck 110 has a leg 124 and a pair of chuck arms 126. The leg 124 extends upwardly from the X table 118 and can be adjusted in height. The chuck arms 126 extend from the leg 124 in the X direction, parallel to each other. The work W is held between the chuck arms 126.

The work W held by the chuck arms 126 is adjusted in position in both the X direction and the Y direction, when the X-Y table 108 is driven in accordance with a pre-stored program. Thus, the work W is positioned and held at a predetermined position with respect to the die unit 78 set at the working position.

How the press apparatus 11 of the structure described above performs press working on the work W will be explained. Assume that the apparatus 11 is to form four bar rings of different shapes at four parts of a work W which is a flat, elliptical metal plate, as is illustrated in FIG. 13.

Four lower dies 86 of different types and four upper dies 87 of different types are attached to four die units 78 of the automatic die-replacing mechanism 24. A bar ring C1 of 80ϕ is made first as shown in FIG. 13A. More specifically, the automatic die-replacing mechanism 24 is operated, positioning the work W held by the chuck arms 126 so that the first working position is set at a predetermined position with respect to the die unit 78. The bottom dead center of the elevating axle 18 is adjusted by controlling the pulse servomotor 38 of the drive mechanism 20, by using software.

The lock lever 100 is moved to the lock-releasing position, and the pulse servomotor 38 is driven by an angle corresponding to a prescribed number of pulses. This causes the oscillating-fulcrum mechanism 22 to lower the elevating axle 18 from the elevated position to the prescribed bottom dead center.

Figure 14A:
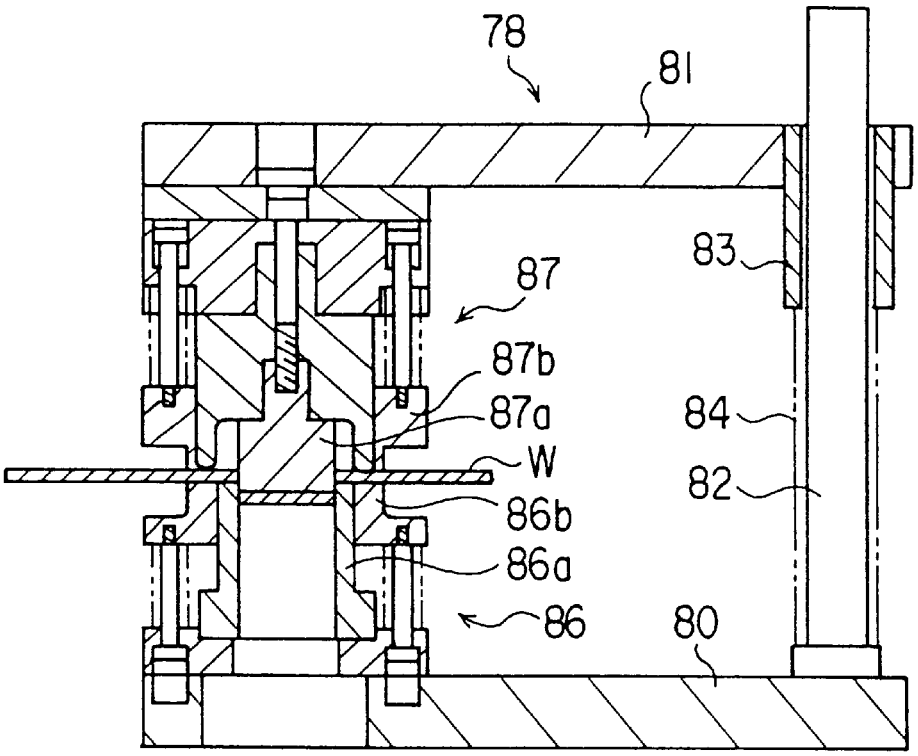
FIGS. 14A and 14B are side views for explaining the operation of the bar-ring press apparatus.
Figure 14B:
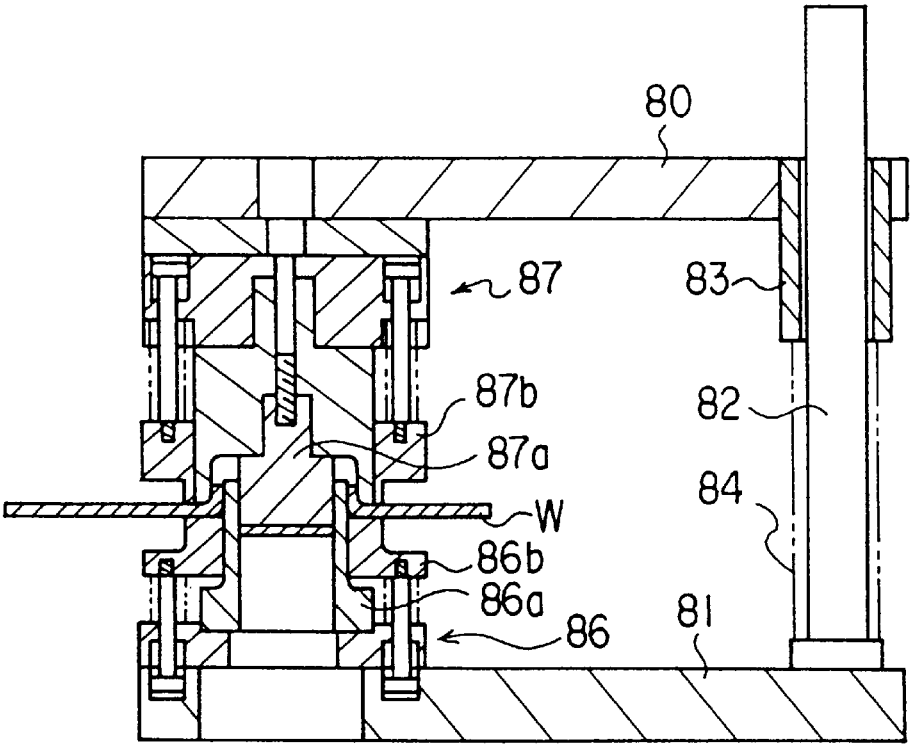

The upper die 87 of the die unit 78 is thereby moved downwardly. The punch 87*a* and die 86*a* cooperate, making a hole in the work W, at the working position thereof, as is shown in FIG. 14A. As the upper die 87 further moves down, the die 86*a* pushes up that part of the work W which surrounds the hole. As a result, a bar ring C1 having a predetermined diameter is formed.

After the bar ring C1 has been formed, the drive mechanism 20 and the oscillating-fulcrum mechanism 22 move the elevating axle 18 back to the elevated position. At the same time, the lock lever 100 is rotated to the lock position. Then, a bar ring C2 of 60ϕ is made in the work W as is illustrated in FIG. 13B.

More precisely, the automatic die-replacing mechanism 24 is operated, setting the die unit 78 for forming the bar ring C2 at the working position. Next, the positioning mechanism 26 positions the second working part of the work W, with respect to the die unit 78. The drive mechanism 20 and the oscillating-fulcrum mechanism 22 lowers the elevating axle 18 to the bottom dead center. As a result, the bar ring C2 is formed in the work W.

Figure 13D:
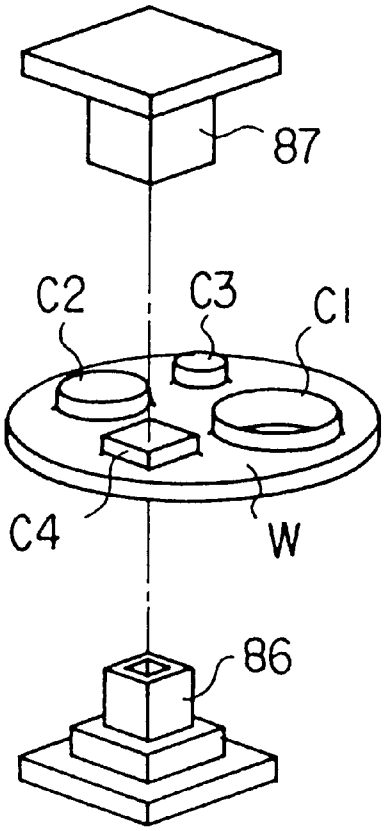
FIGS. 13A to 13D are exploded views of a work being pressed by the press apparatus and a plurality of dies used in the press apparatus.
Figure 13C:
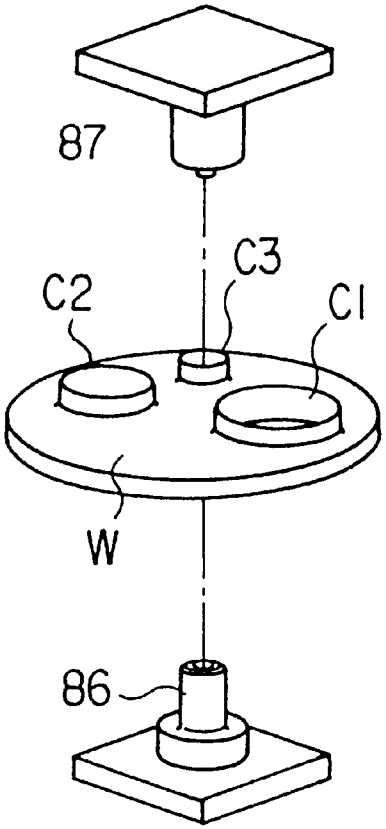
Figure 13B:
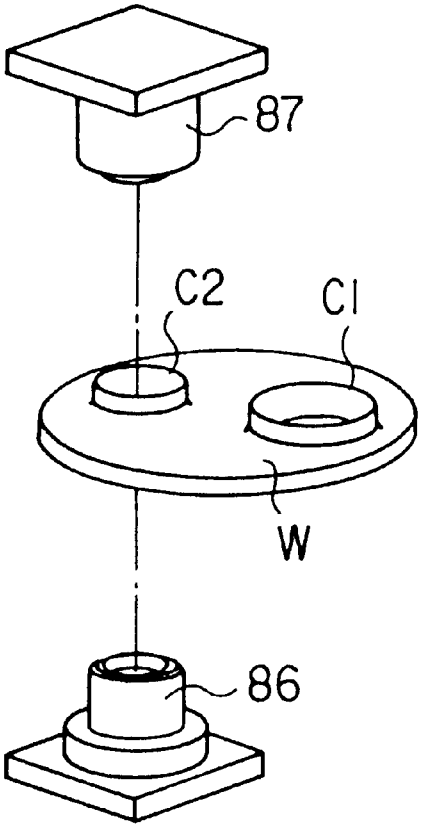
Figure 13A:
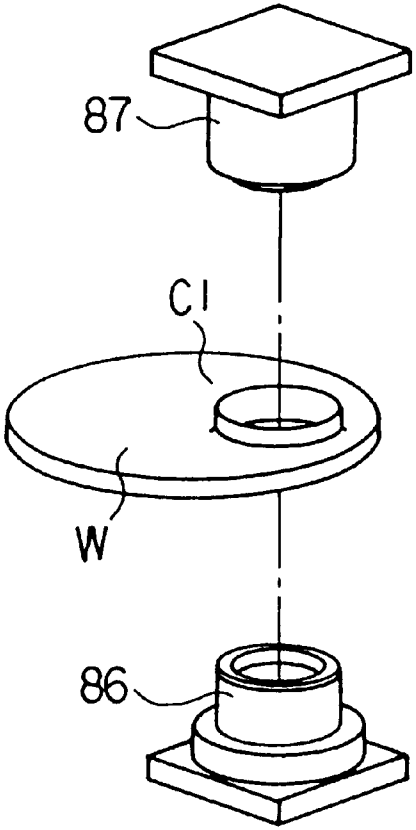

Thereafter, the die unit 78 is replaced with another automatically, and a bar ring C3 of 40ϕ and a rectangular bar ring C4 are formed in the work W, as is shown in FIGS. 13C and 13C.

In the bar-ring press apparatus having the structure described above, a prescribed gap is provided above the base 10, thus providing a sufficient working space between the base and the drive mechanism section. The automatic die-replacing mechanism 24 is set in the working space, making it possible to realize a press apparatus in which dies of various types can be replaced one with another. The automatic die-replacing mechanism 24 can set any desired die unit at the working position and couple the same to the elevating axle 18, merely by rotating the turret table 74. This is made possible because each die is unitized. It is therefore possible to replace one die with another quickly.

The pulse servomotor 38 is used as drive mechanism 20 and the oscillating-fulcrum mechanism 24 is used as a drive-force transmitting mechanism, thereby performing press working. Hence, the bottom dead center and top dead center of the can be adjusted, only by controlling the pulse servomotor by using software. This helps to quickly set the die which has replaced the die used before.

The oscillating-fulcrum mechanism 24 has a power-point section, a fulcrum section, and an application-point section. The power-point section can rotate around the shaft 42, the fulcrum section is supported by the fulcrum regulator and can oscillate, and the application-point section is supported by the application-point regulator and can oscillate. Therefore, no power loss in the side-thrust direction occurs at the fulcrum section or the application-point section. The drive force of the drive mechanism 20 can thereby be transmitted to the elevating axle 18 without a loss. Press working can therefore be performed with high efficiency, and the consumption of electric power can be reduced.

Moreover, a thrust loss is eliminated, the vibration can be greatly reduced during the press working. This prevents displacement of the elevating axle 18 and the die. The press apparatus can therefore perform high-precision press working. Further, since the displacement decreases, each die can be precisely aligned when it replaces the die that has been used. The dies can therefore be automatically replaced with one another with high efficiency.

In the embodiment described above, a plurality of dies can be automatically replaced one with another, and each die can be set at the working position, within a short time. The embodiment is therefore a press apparatus which can serve to manufacture various type of products, each in small quantities.

A press system, which is another embodiment of the present invention, will be described. The embodiment described above is a press apparatus 11 which has an automatic die-replacing mechanism and which performs various types of press working. The press system is a combination of a plurality of press apparatuses and a transport mechanism designed to convey a work in one direction. The press system can therefore carry out various types of press working on each work.

Figure 15:
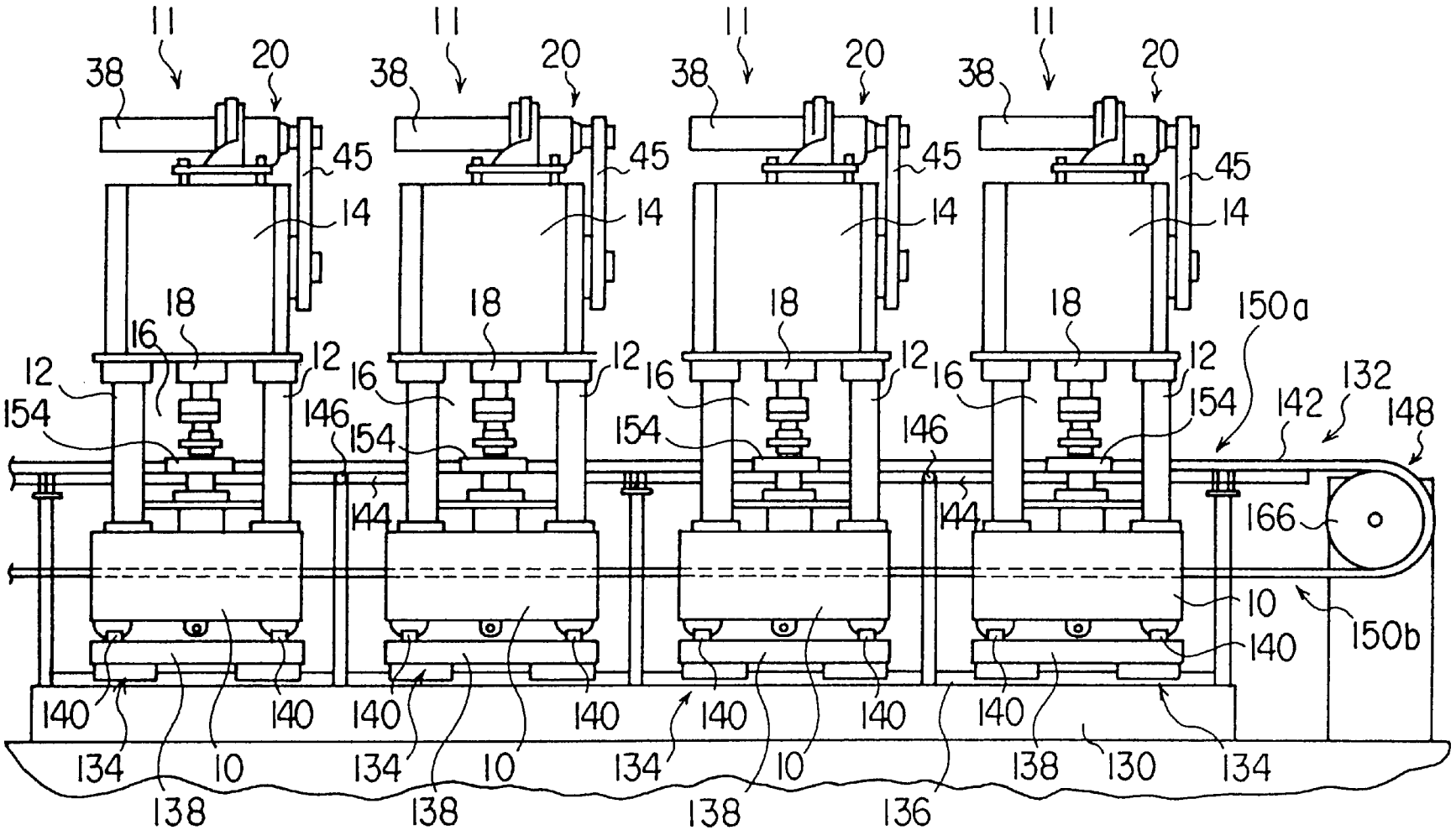
FIG. 15 is a side view of a press system according to the invention.
Figure 16:
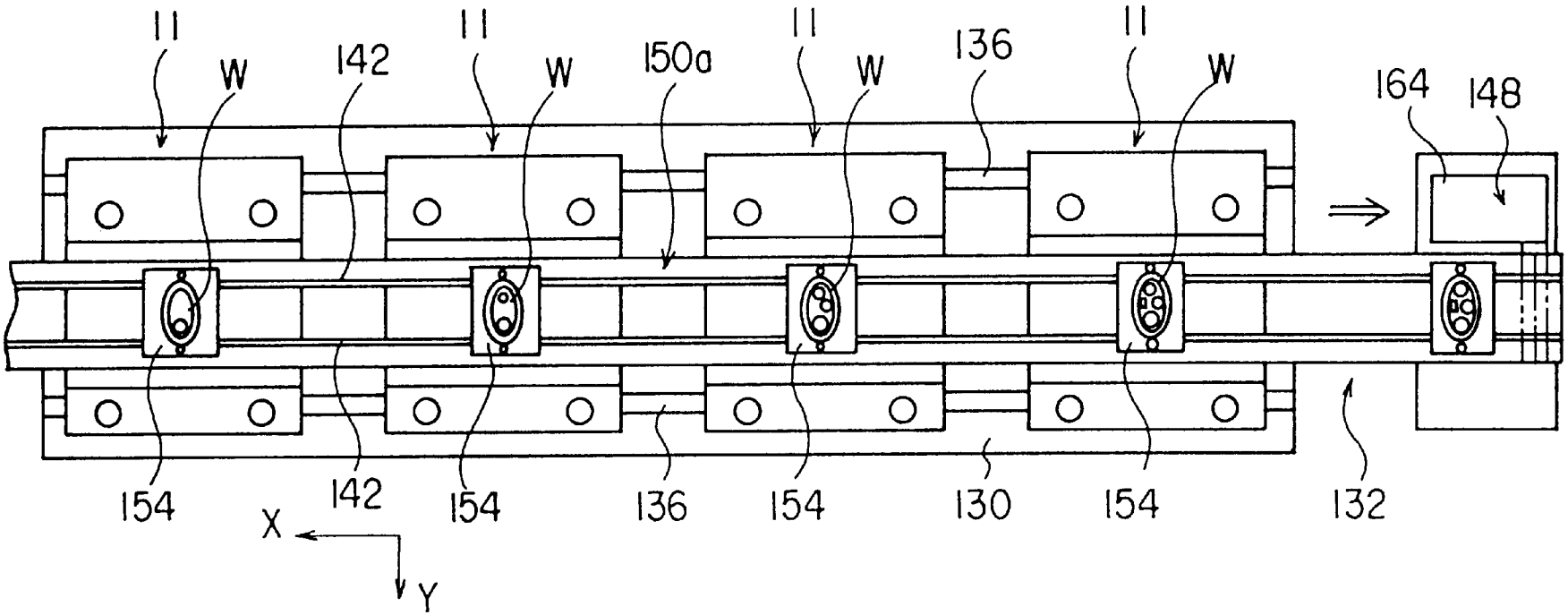
FIG. 16 is a schematic plan view of the press system.
Figure 17:
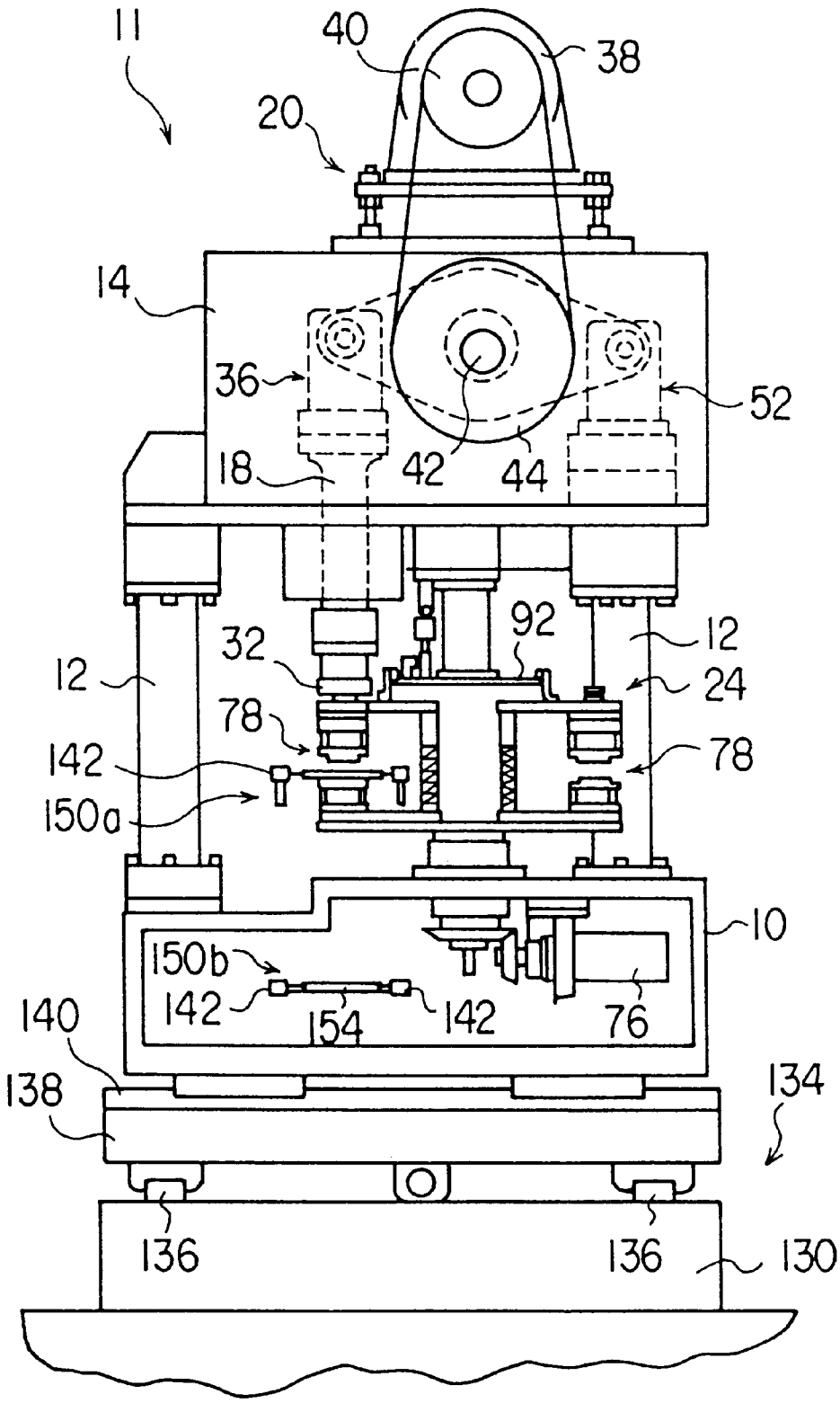
FIG. 17 is a side view showing one of the press apparatuses incorporated in the press system.
Figure 18A:
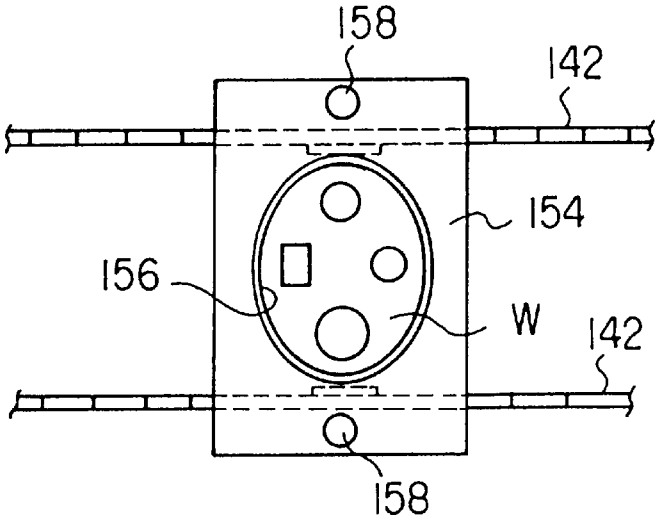
FIGS. 18A, 18B and 18C are respectively a plan view, side view and front view showing the transport mechanism and work holder incorporated in the press system.
Figure 18B:
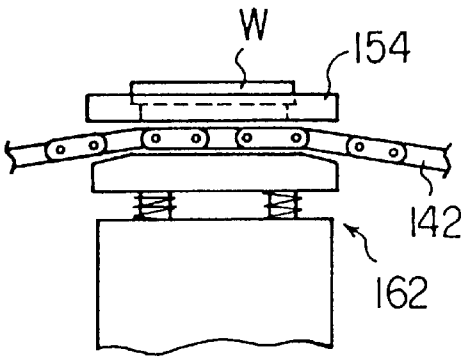
Figure 18C:
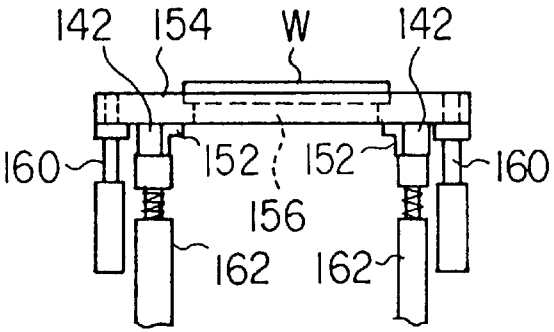

As shown in FIGS. 15 to 17, the press system comprises, for example, four bar-ring press apparatuses 11 and a transport mechanism 132. The press apparatuses 11 are arranged in a row on an elongated base 130. The transport mechanism 132 is provided on the base 130, for conveying a work W in one direction through the press apparatuses 11.

Each press apparatus 11 is identical to the press apparatus according to the embodiment described above, except that a positioning mechanism 26 is not provided. That is, each press apparatus 11 comprises a base 10, four posts 12 standing on the base 10, and a support frame 14 supported by the poles 12. A working space 16 is provided between the base 10 and the support frame 14.

The support frame 14 is equipped with an elevating axle 18. The elevating axle 18 is provided for opening and closing a die and is supported to be move up and down, in the vertical direction. A drive mechanism 20 and an oscillating-fulcrum mechanism 22 are mounted on the support frame 14. The drive mechanism 20 functions as drive means. The oscillating-fulcrum mechanism 22 is designed to transmit a drive force from the mechanism 20 to the elevating axle 18. An automatic die-replacing mechanism 24 having a plurality of die units is provided in the working space 16.

The components of each press apparatus 11, which are identical to those of the embodiment described above are designated at the same reference numerals and will not be described in detail.

Each press apparatus 11 is mounted on one X-Y table 134 which is provided on the base 130 and which functions as a position-adjusting means. The X-Y table 134 comprises a pair of rails 136 and an X table 138. The rails 136 are laid on the base 130, extending in X direction over the entire length of the base 130. The X table 138 can reciprocate on the rails 136 in the X direction. A pair of rails 140 are laid on the X table 138, extending in Y direction. The base 10 of the press apparatus 11 can reciprocate on the rails 140 in the Y direction. That is, the base 10 serves as a Y table.

laid on the upper surface of the base 10, in the X direction, namely along a line extending at right angles to the shaft 42 of the oscillating-fulcrum mechanism 22. The Y table 118 can reciprocate on a pair of rails 116 laid on the X table 114, in the Y direction, namely along a line extending parallel to the shaft 42.

The X table 138 is moved back and forth by a pulse motor and a lead screw, either not shown. The base 10 is also moved back and forth by a pulse motor and a lead screw, either not shown.

The transport mechanism 132 comprises a pair of endless chains 142, a chaarn guide 144, a plurality of tentioners 148, and a drive mechanism 148, and the like. The endless chains 142 are belt-like members. The chaarn guide 144 guides these chaarns 144. The tensioners 146 applies a tension to the chaarns 144. The drive mechanism 148 drives the chaarns 144.

The forward-going parts 150*a* of the chains 142 run, passing through the working space 16 of each press apparatus 11, extending along the sides of the die unit 87 set at the working position. The backward-going parts 150*b* of the chains 142 run, passing through the base 10 of each press apparatus 11.

As shown in FIGS. 15 to 18C, a number of holding jigs 154 are connected to the pair of chains 142, spaced apart at prescribed intervals in the direction in which the chains 142 run. Each holding jig 154 is shaped like a rectangular plate and fastened to the chains 142 by fasteners 152. Each holding jig 154 has a work-holding section 156 which is a stepped through hole. A work W is removably set in the work-holding section 156.

Each holding jig 154 has positioning holes 158, each in one end portion. In each press apparatus 11, a pair of positioning pins 160 and a chaarn-supporting mechanism 162 are provided at a position where a holding jig 154 holding a work W opposes the die unit 78. The positioning pins 160 slip into the positioning holes 158, positioning the holding jig 154. The chaarn-supporting mechanism 162 supports the chaarns 142, elastically biasing the same from below.

The drive mechanism 148 has a drive sprocket 166 that is driven by a pulse motor 164. A work pickup mechanism (not shown) is provided between the drive mechanism 148 and the press apparatus 11 located adjacent to the mechanism 148. The work pickup mechanism removes the work W from the holding jig 154 after the work W has been press-worked.

How the press system described above form a bar ring on the work W will be explained. More precisely, it will be explained how the press system form, for example, four bar rings C1 to C4 on the work W, as does the embodiment described above.

First, in each press apparatus 11, the automatic die-replacing mechanism 24 sets a prescribed die unit 78 at the working position. In this case, four die units 78 of different types designed to form bar rings C1 to C4 are set in the working positions of the four press apparatuses, respectively.

Next, the X-Y tables 134 are driven in accordance with the pre-stored program. The press apparatuses 11 are thereby moved to prescribed positions with respect to the transport mechanism 142. That is, the die unit 78 of each press apparatus 11 is adjusted and set at a predetermined working position with respect to the work W conveyed by the transport mechanism 132. The bottom dead center and top dead center of the elevating axle 18 are adjusted in accordance with the die unit 78 thus set, by using software.

Thereafter, the work W is mounted on the holding jig 154 of the transport mechanism 132, and the drive mechanism 148 is operated, causing the chaarns 142 to run. The drive mechanism 148 is stopped when the four holding jigs 154 reach the positions where they oppose the die units 11 of the respective press apparatuses 11. At the same time, the positioning pins 160 provided at the press apparatuses 11 position the holding jigs 154.

In this condition, the drive mechanisms 20 of the four press apparatuses 11 are operated at the same time, forming four bar rings on four works W, respectively. Then, the transport mechanism 142 is operated again, conveying the holding jigs 154 to prescribed positions with respect to the press apparatuses 11. The press apparatuses 11 are operated. The same sequence of steps is repeated, whereby works W, each having four bar rings C1 to C4, are manufactured one after another.

In the press system described above, each press apparatus 11 has a working space 16 between the base 10 and the drive mechanism section. The transport mechanism 142 can extend through the working spaces 16 and can convey each work W in one direction to a plurality of press apparatuses. This helps to the press-working time, greatly enhancing the efficiency of press working.

The plurality of press apparatuses 11 arranged in a row on the base 130 are mounted on the X-Y tables 134 and can be adjusted in position with respect to the transport mechanism 142. The die units 78 can therefore be set at desired positions with respect to the works W conveyed by the transport mechanism 142. Each work W can be press-worked at a desired part by one die unit 78. Further, since each press apparatus has an automatic die-replacing mechanism, the die unit can be quickly replaced with another, and various types of press working can be performed on the work W. As a result, the press system can manufacture various type of products, each in small quantities.

Each press apparatus 11 has an oscillating-fulcrum mechanism 22. Hence, the thrust loss is eliminated during the press working as in the embodiment described above, making it possible to reduce the vibration greatly. Although the press apparatuses 11 are provided on position-adjusting mechanisms such as X-Y tables, the adjusted position does not change, maintaining high precision of positioning. Namely, a press system can be realized which has a position-adjusting mechanism.

The present invention is not limited to the embodiments described above. Various changes can be made within the scope of the invention. For example, the press apparatus and press system according to the invention can be applied not only to a bar-ring press, but also to other various types of presses.

The fulcrum regulator and the application-point regulator, both incorporated in the oscillating-fulcrum mechanism of the press apparatus, are of outer-fulcrum structure in which the support block supporting the fulcrum and application point of the arm rotatably is supported so as to move linearly. Instead, they may be of inner-fulcrum structure in which rotatable rollers are provided at the fulcrum and application point, a linear guide is provided on the support block, and the rollers are arranged to roll along the guide.

In the automatic die-replacing mechanism of the press apparatus, the number of die units provided is not limited to four. More or less die units may be provided in the mechanism. In the relief mechanism of the press apparatus, a coil-spring mechanism that can effect limit operation may be used as bias means, in place of the belleville springs. In the press system, the number of press apparatuses provided can be increased or decreased if necessary, and the die-replacing mechanism can be dispensed with. Further, in the transport mechanism 142, the chaarns may be replaced by other components such as belts.

Industrial Applicability

As has been described in detail, the present invention can provide a press apparatus which comprises a oscillating-fulcrum mechanism and an automatic die-replacing mechanism and which can easily serve to manufacture various types of products, and also a press system which comprises a plurality of press apparatuses of this type, a position-adjusting mechanism and a transport mechanism and which can easily serve to manufacture various types of products.

What is claimed is:

1. A press apparatus comprising:

a base;

a support frame arranged above the base, defining a predetermined working space together with the base;

an automatic die-replacing mechanism having a plurality of die units disposed in the working space, for moving a selected one of the die units to a prescribed working position;

an elevating axle supported by the support frame to move up and down freely for opening and closing the die unit set at the working position;

drive means provided on the support frame; and an oscillating-fulcrum mechanism for transmitting a drive force of the drive means to the elevating axle, thereby to move the elevating axle up and down, said oscillating-fulcrum mechanism comprising:

a shaft supported by the support frame, to be rotated by the drive means;

an eccentric core formed integral with the shaft and positioned eccentric thereto;

an oscillating arm having a power-point section supported to rotate freely around the eccentric core, a fulcrum section and an application-point section provided at another end of the power-point section;

a fulcrum regulator supporting the fulcrum section of the oscillating arm, allowing the same to rotate freely and to oscillate linearly in a predetermined direction intersecting with a direction in which the elevating axle moves up and down; and an application-point regulator coupling the application-point section of the oscillating arm with the elevating axle, allowing the application-point section to rotate freely and oscillate linearly in a predetermined direction intersecting with the direction in which the elevating axle moves up and down.

2. A press apparatus according to claim 1, characterized in that said automatic die-replacing mechanism comprises a turret table rotatably arranged on said base and supporting said plurality of die units and table-rotating means for rotating the turret table to move a selected one of the die units to the working position, said elevating axle has a holder for holding the die units, and each of said die units has an engagement section which engages with the holder when the die unit is moved to the working position.

3. A press apparatus according to claim 2, characterized in that each of said die units comprises a lower plate to which a lower die is removably attached, an upper plate to which an upper die is removably attached, and guide posts supporting the upper plate to be movable move up and down with respect to the lower plate, said lower plate is secured on the turret table, and said engagement section is provided on the upper plate.

4. A press apparatus according to claim 3, characterized in that said engagement section of each of said die units has a shank protruding from the upper plate, said holder of the elevating axle has an engagement groove into which the shank is inserted when the die unit is moved to the working position.

5. A press apparatus according to claim 4, characterized in that said automatic die-replacing mechanism comprises a disc-shaped support table secured to the support frame and opposing the turret table in axial alignment therewith, each of said die units has a support roller provided on the upper plate and rotatably supported on the support table, and said automatic die-replacing mechanism has an opening formed in the support table and opposing the support roller when the die unit is moved to the working position, and a lock mechanism movable between a lock position where the lock mechanism closes the opening to lock the support roller on the support table and a lock-releasing position where the lock mechanism opens the opening to allow the support roller to pass through the opening.

6. A press apparatus according to claim 1, characterized in that a positioning mechanism is provided on the base, for holding and positioning a work with respect to the die unit moved to the working position.

7. A press apparatus according to claim 1, characterized in that said fulcrum regulator comprises a support block supporting the fulcrum section of the oscillating arm in a rotatable state, and a support plate supporting the support block, allowing the same to oscillate linearly in a predetermined direction.

8. A press apparatus according to claim 7, characterized in that a relief mechanism is provided for relieving a load from the die unit through the elevating axle when the load on the die unit exceeds a predetermined value, said relief mechanism comprising a support rod supporting the support plate to be movable up and down with respect to the support table, and bias means arranged between the support plate and the support table, for holding the support plate and the support rod at an elevated position and deforming to allow the support plate to move down and relieve the load when the load applied through the support block exceeds the predetermined value.

9. A press apparatus according to claim 8, characterized in that said bias means has a plurality of belleville springs mounted on and secured to the support rod and arranged between the support table and the support plate.

10. A press apparatus according to claim 1, characterized in that said application-point regulator comprises a support block supporting the application-point section of the oscillating arm in a rotatable state and a support plate secured to the elevating axle and supporting the support block to allow the same to move linearly in the predetermined direction.

* * * * *